United States Patent [19]

Jaffeux et al.

[11] Patent Number: 5,042,414

[45] Date of Patent: Aug. 27, 1991

[54] ANCHORING DEVICE WITH STABILIZING PIECE

[75] Inventors: François Jaffeux; Rémi Jaffeux, both of Riom Cedex, France

[73] Assignee: ALERTIE (S.A.R.L.), France

[21] Appl. No.: 463,418

[22] Filed: Jan. 11, 1990

[30] Foreign Application Priority Data

Jan. 18, 1989 [FR] France ..... 89 00848

[51] Int. Cl.[5] ..... B63B 21/50

[52] U.S. Cl. ..... 114/293

[58] Field of Search ..... 114/230, 293, 294, 310, 114/221 R

[56] References Cited

U.S. PATENT DOCUMENTS

| | | | |
|---|---|---|---|
| 3,055,332 | 9/1962 | Linsdeau | 114/294 |
| 3,062,168 | 11/1962 | Backe | 114/294 |
| 3,111,926 | 11/1963 | Shatto | 114/294 |
| 3,726,247 | 4/1973 | Dalzell | 114/293 |
| 3,949,441 | 4/1976 | Menzel et al. | 114/294 |
| 4,067,282 | 1/1978 | Guinn et al. | 114/293 |

*Primary Examiner*—Sherman Basinger
*Assistant Examiner*—Stephen P. Avila
*Attorney, Agent, or Firm*—Ladas & Parry

[57] ABSTRACT

The device according to the invention comprises an anchor, a chain connecting the anchor to a craft and a heavy stabilizing piece which, when the anchor is on the sea-bed, is fast with the chain in an immersed zone of the chain. The stabilizing piece consists of an assembly composed of two masses of the same triangular shape, connected together at one apex of the triangle by the pin of a pulley, allowing the piece to slide on the chain. This stabilizing piece is maintained fast with the chain above the sea-bed, thanks to a rope of which one end is fixed to the piece by a support and of which the other end is fixed to the craft. The invention is more particularly applicable in the domain of craft of low tonnage.

6 Claims, 5 Drawing Sheets

ANCHORING DEVICE WITH STABILIZING PIECE

FIELD OF THE INVENTION

The present invention relates to the anchoring of boats, and in particular of pleasure boats, yachts or motor boats, and, in general, craft of low tonnage. It concerns an improved device for increasing the stability of the anchored craft with respect to the wind.

BACKGROUND OF THE INVENTION

A craft, once anchored, tends to move as a function of the stresses exerted thereon, and in particular by the wind. Such displacements are all the greater as, for a given tonnage, the surface exposed to the wind is large. Furthermore, the use of materials of the composite type, which are much lighter, reduces the tonnages for a given length of the craft and lateral surface thereof; such reduction in the tonnage correlatively reduces the inertia of the craft. Displacements when anchored bring about repeated variations in tension on the anchor chain or cable, which may cause the anchor to be torn away, which is the principal cause of wrecks. In order to simplify the following description, the term "chain" will alone be used, it being understood that another anchoring means such as a synthetic cable may also be employed.

U.S. Pat. No. 3,055,322 discloses so-called "sentinel" devices intended to improve the stability of the craft by performing to some extent a role of damper of the variations exerted on the chain. These devices consist in a heavy piece which is fixed on the cable between the anchor and the craft. Normally, the sentinel rests on the sea-bed; if the tension increases further to the craft drifting, the sentinel rises so that the subsequent increase in weight opposes the movement of the craft. The sentinel is solidly fixed to the cable with the aid of a retaining system which imprisons the cable.

This device, which has been known for about thirty years, is not entirely satisfactory, principally because assembly thereof requires that the anchor be raised and the zone of the chain where said device must be fixed be accessible to the operator. Furthermore, it is rigidly fixed to the chain and its position cannot be changed when the anchor is cast.

SUMMARY OF THE INVENTION

An anchoring device has now been found, and this forms the subject matter of the present invention, which overcomes the drawbacks of the sentinel of U.S. Pat. No. 2,055,332, in that it is placed in position when the anchor is cast, and in that it is not rigidly fixed to the chain. This anchoring device comprises, in known manner, a heavy, so-called stabilizing piece, which, when the anchor is on the sea-bed, is fast with the chain in an immersed zone of the chain. The anchoring device according to the invention is characterized in that it comprises sliding means adapted to slide the stabilizing piece along the chain and holding means adapted to hold the piece, above the sea-bed, in a zone of the chain which is located at a distance from the point of attachment of the chain with the craft which is less than the depth of water beneath the craft. For a craft having a tonnage of between 1.5 and 15 tons, for a length of 6 to 15 metres, the stabilizing piece preferably weighs from 15 to 30 kg.

The stabilizing piece is preferably fast with the chain in a zone included between one half and four fifths of the length of the chain between the anchor and the craft, measured from the anchor.

In a preferred embodiment of the invention, the stabilizing piece comprises two identical masses and the sliding means consist of a grooved pulley of which the rotational pin connects the peripheral zones of the two masses. "Peripheral zone" is understood to mean a zone which is remote from the centre of gravity of the mass. According to this preferred embodiment, when the device is positioned on the chain, the latter being in the groove of the pulley, the two masses thus ensure equilibrium of the device, with their centres of gravity equally distributed beneath the level of the pulley.

Each mass is, for example, of overall triangular shape, the pin of the pulley connecting the two masses at an apex of the triangle.

Each mass is preferably rotatable about the pin of the pulley and comprises in the peripheral zone opposite the peripheral zone of connection a slot for gripping. If the mass is overall triangular in shape, the slot will be parallel to the side opposite the connection apex.

This latter arrangement is particularly advantageous as it renders positioning of the device on the chain much easier; the user can grip the device by the slot made in one of the two masses, using it as a handle.

The pulley is preferably made of hard rubber, in order to avoid noise rising in the craft, such noise due to the sound waves when the device moves on the chain under the effect of the tension shocks.

The device possibly comprises a locking system consisting of a rod connecting the two masses beneath the rotational pin of the pulley.

The holding means may consist of a rope of which one end is fixed to the craft and the other to the stabilizing piece and whose length corresponds to the distance between the craft and that zone of the chain where the stabilizing piece is to be maintained fast.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
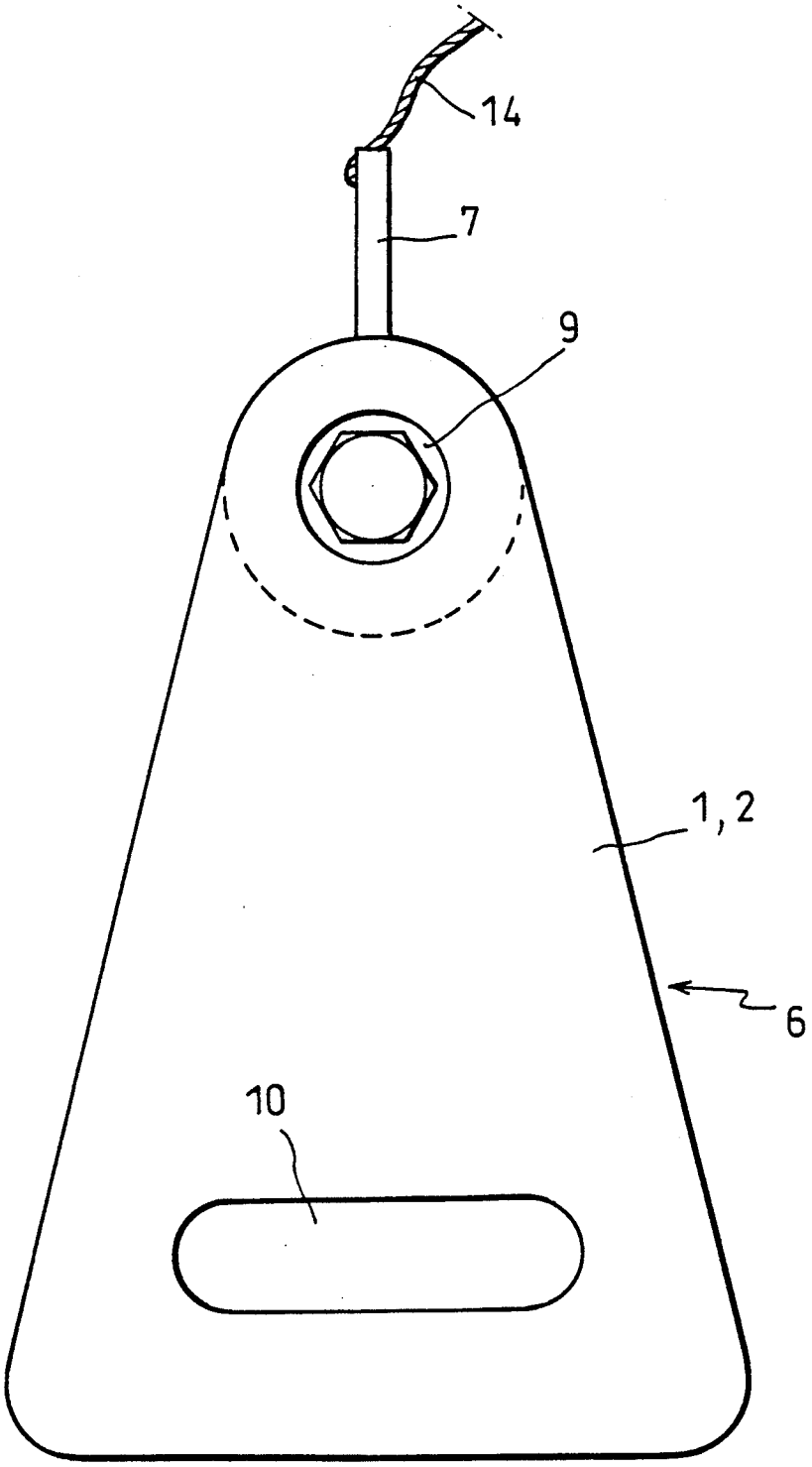
FIG. 1 is a front view of the stabilizing piece incorporating two triangular masses.
Figure 2:
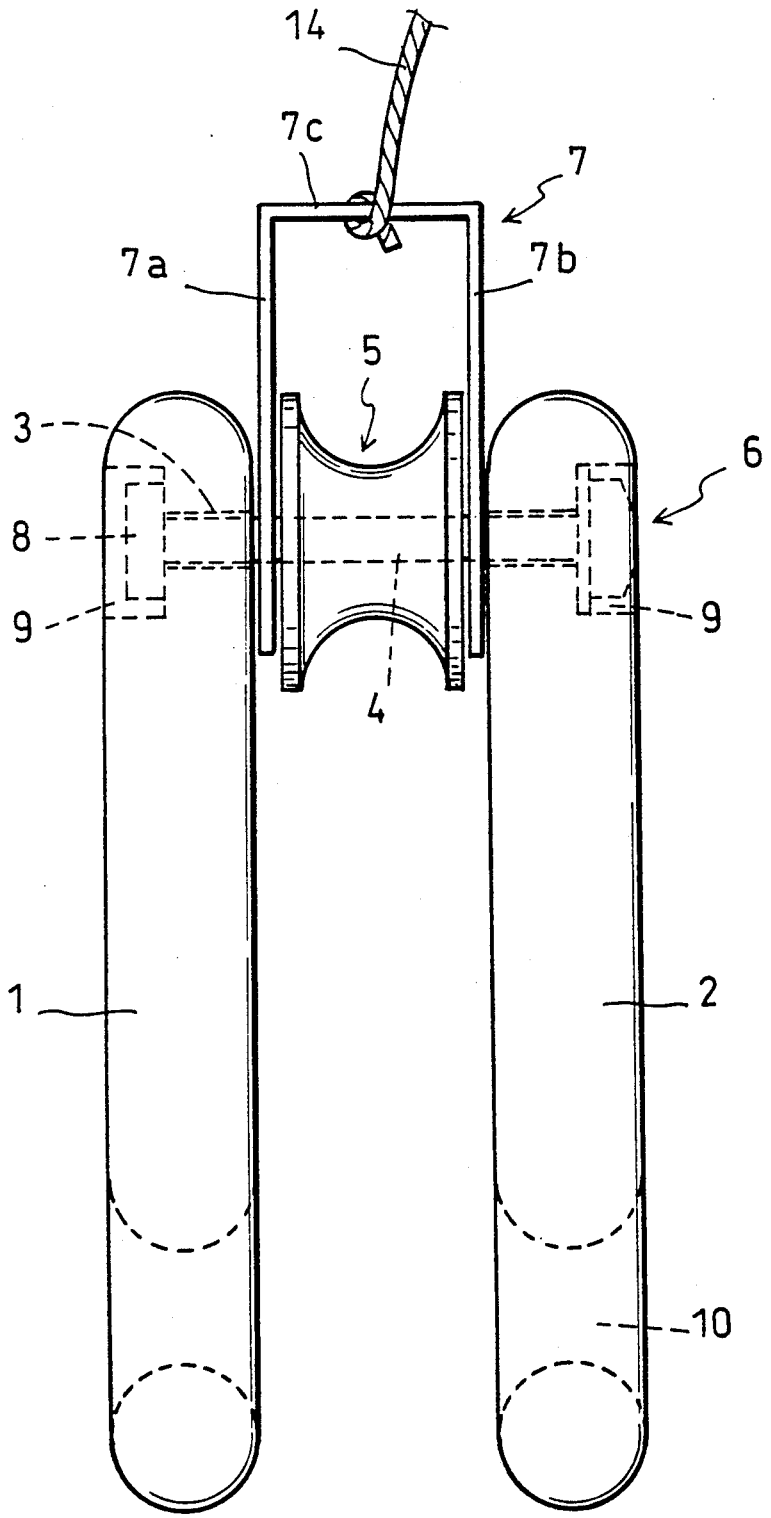
FIG. 2 is a side view of the piece of FIG. 1.

Referring now to the drawings, in the first embodiment of a stabilizing piece illustrated in FIGS. 1 and 2, each of the two masses 1 and 2 has the same triangular shape, of which the three apices are rounded; they are made of a material having a density at least equal to 5 and resistant to the corrosion of sea-water; their dimensions are a function of the desired weight. For a total weight of 15 kg, each mass has for example the shape of an isosceles triangle of which the base measures 20 cm and the two sides are equal to 30 cm, for a thickness of 4 cm. In its upper part, near the apex of the triangle, each mass presents a hole 3 through which passes the pin 4 about which the pulley 5 freely rotates. FIG. 2 shows the arrangement of the different elements of which the stabilizing piece 6 is composed: a support piece 7 in the form of a U, whose arms present a hole in their end part, is interposed between the sides of each pulley 5 and each mass 1 and 2; the assembly constituted successively by the first mass 1, the first arm *7a* of the support 7, the pulley 5, the second arm *7b* of the support 7, the second mass 2, is locked by nut 8 cooperating with the threaded end of the screw 4 constituting the pin. The head of the screw 4 as well as the nut 8 are housed in parts 9 outwardly milled around hole 3. Washers (not shown in FIG. 2) are placed between the different elements so as to allow free movement of each element despite blockage of the assembly.

A slot 10 is made in each mass 1 and 2, parallel to the base of the triangle. This slot 10 acts as handle when the stabilizing piece 6 is manipulated.

The U-shaped support piece 7 is perforated so as to be able to introduce and fix thereon a rope 14 as will be explained hereinafter. The distance between the transverse part *7c* of the support and the pulley 5 is possibly sufficient to insert one or more fingers.

Figure 3:
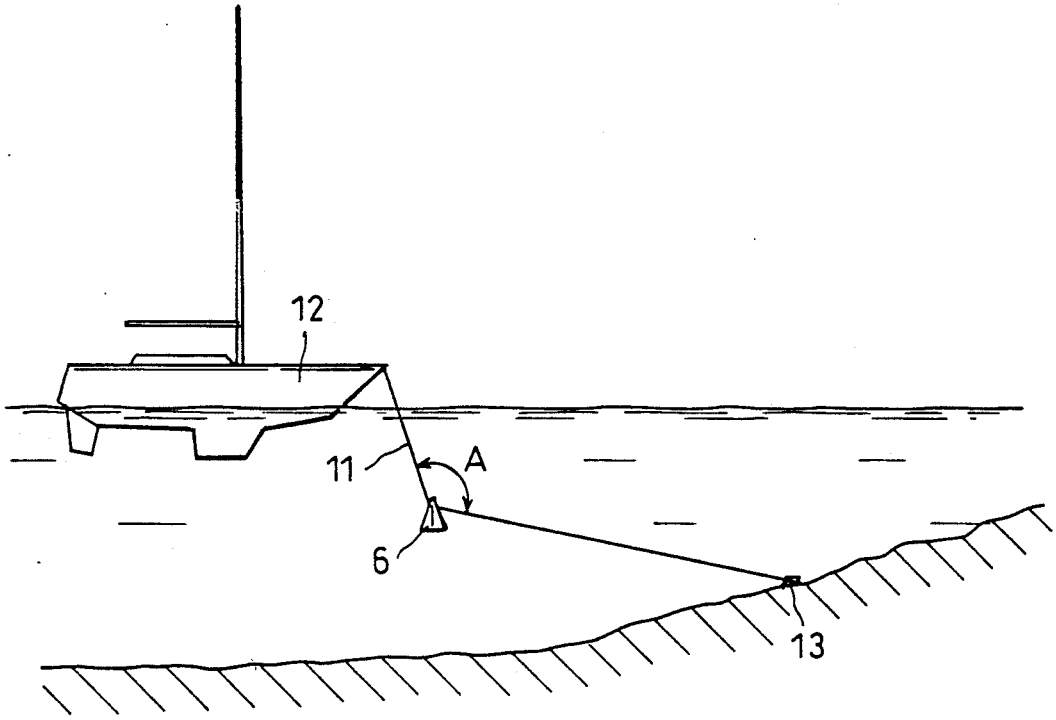
FIG. 3 is a schematic view of the device fast with the anchor chain.
Figure 4:
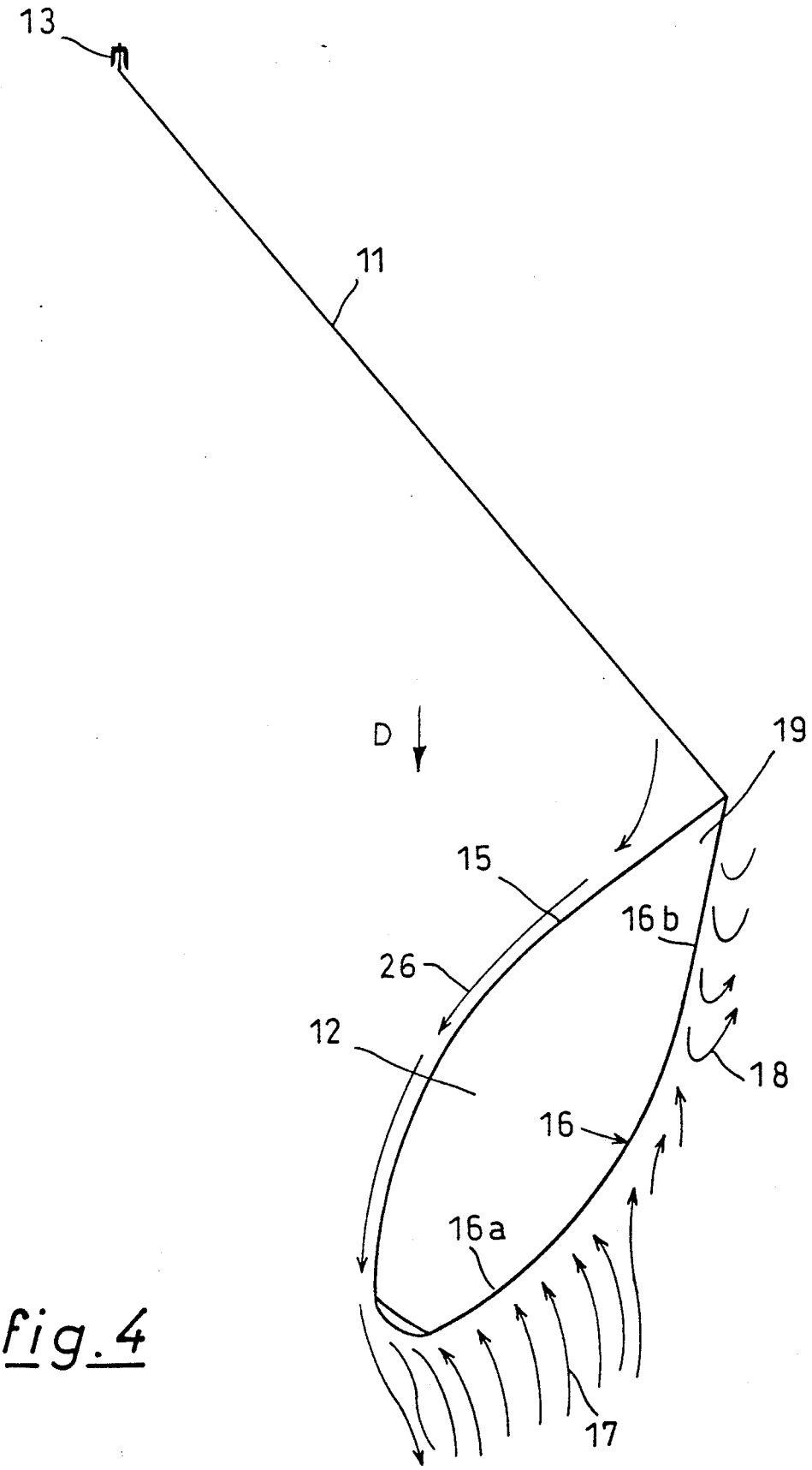
FIG. 4 is a schematic view from above showing the lateral displacement of the craft under the action of the wind.

The pulley 5 has an inner diameter at the level of the groove, of the order of 5 to 8 cm. It is this pulley 5 which allows the stabilizing piece 6 to slide on the chain 11 connecting the craft 12 to the anchor 13, when the latter is on the seabed as shown in FIG. 3.

The width of the groove of the pulley 5 corresponds to the size of the corresponding chain 11. The pulley is preferably made of hard rubber.

The device is employed under the following conditions. The chain 11 which connects the anchor 13 to the craft 12 is generally fixed at the bows thereof. Depending on the craft, the bows include an overhang with guide pulley for the chain 11, or an overhang without pulley, or does not comprise an overhang at all. With the aid of the guide pulley, if there is an overhang, or manually if not, the stabilizing piece 6 is placed so that the chain 11 is in contact with the groove of pulley 5 and in the inner part between the two masses 1 and 2.

Mass 1 may for example be gripped by one hand in its slot 10 forming handle and the other hand may grip a rope 14 of which one end is solidly fixed on the transverse part *7c* of the support 7. Once the groove of the pulley 5 has been positioned on the chain, having been guided with the aid of mass 2, mass 1 is released and returns into position by pivoting about pin 4 under the effect of its weight. Piece 6 slides freely along chain 11, due to the rotation of pulley 5 and to the drive of masses 1 and 2: the centre of gravity of piece 6 being lower than the groove of pulley 5 in contact with the chain, piece 6 is stable in its descent along chain 11. Once the stabilizing piece 6 has reached the predetermined zone above the sea-bed, it is stopped by rope 14 being blocked and fixed on the craft.

The zone in which the stabilizing piece 6 is positioned on chain 11 is a function of the depth of the sea-bed and of the length of the chain once the anchor is cast. It is conventional if the length of the chain is at least three times greater than the depth of water under the craft. The stabilizing piece is preferably positioned on the chain in a zone which is at a distance from the point of attachment on the craft which is slightly less than the depth of water. This arrangement makes it possible to avoid rope 14 making knots with chain 11, particularly when the craft rotates on itself in the absence of wind.

With the device thus placed on chain 11, it is observed that the lateral displacements of the craft 12, due to the wind, are less pronounced and less violent, improving stability of the craft with respect to the wind and reducing the risks of the anchor being torn away.

An attempt may be made to explain the result thus obtained The craft is fast with the sea-bed by a chain which is fixed at its bows and which is anchored to the sea-bed. It therefore has the possiblity of moving over the water in a zone of evolution which is defined by the length of the chain. Due to the presence of the wind in the direction of arrow D, an air flow 26 is created along the face 15 of the craft exposed to the wind, and, on the other face 16, opposite the wind, on the one hand, a depression 17 at the stern *16a* and, on the other hand, turbulences 18 at the bows *16b*. It is these turbulences 18 which pull the craft 12 on the corresponding board and forwardly, until the craft 12 has a position which makes a maximum angle with the wind and for which these aerodynamic phenomena cease. Once this position has been reached, the craft pivots about stem 19, which causes a change of the face exposed to the wind and therefore recoil of the craft, perpendicularly to the direction of the wind, until chain is tensioned.

All these displacements provoke tension shocks on the chain, shocks which are all the more violent as the inertia of the craft is reduced and the wind strong.

The stabilizing piece 6, fast with the immersed chain 11, provokes by its weight a deviation of the general direction of the chain 11 between the craft 12 and the anchor 13, tending to cause the gradient of the chain 11 in that portion of chain included between piece 6 and anchor 13, to approach the horizontal. Such deviation is illustrated in FIG. 3 by angle A. The directions of the chain between craft 12 and piece 6, on the one hand, and piece 6 and anchor 13 on the other hand, are, in fact, not rectilinear as shown in FIG. 3, but are curved due to the weight of the chain itself in two different curvatures. These curvatures vary depending on the intensity of the traction exerted on the chain. As the length of the fixing rope 14 is constant, any variation in the curvature of the direction of the chain 11 between craft 12 and stabilizing piece 6 induces a displacement of chain 11 with respect to the stabilizing piece. Such displacements may produce noises which reverberate in the craft, but this is avoided by employing pulley 5.

As explained hereinabove, the action of the wind provokes lateral displacements of the craft 12. These displacements exert on the anchor 13, via the chain 11, forces of traction which are not longitudinal to the shank of the anchor 13. The presence of the stabilizing piece 6 on the chain 11, reducing, due to angle A, the zone of evolution of the craft, reduces the amplitude of these lateral displacements and consequently the non-longitudinal forces of traction exerted on the anchor 13. Moreover, the forces of traction are translated by an increase in angle A, which is opposed by the masses 1 and 2 which perform the role of return force. In this way, the stabilizing piece 6, maintained in position on the immersed chain 11, constitutes a progressive damper by gravity.

The invention is not limited to the embodiment which has just been described by way of example, but covers all the variants thereof.

It has been satisfactorily applied to the stabilization of the anchoring of yachts of up to 15 metres and of motor boats of up to 15 metres, for tonnages of up to 15 tons.

Figure 5:
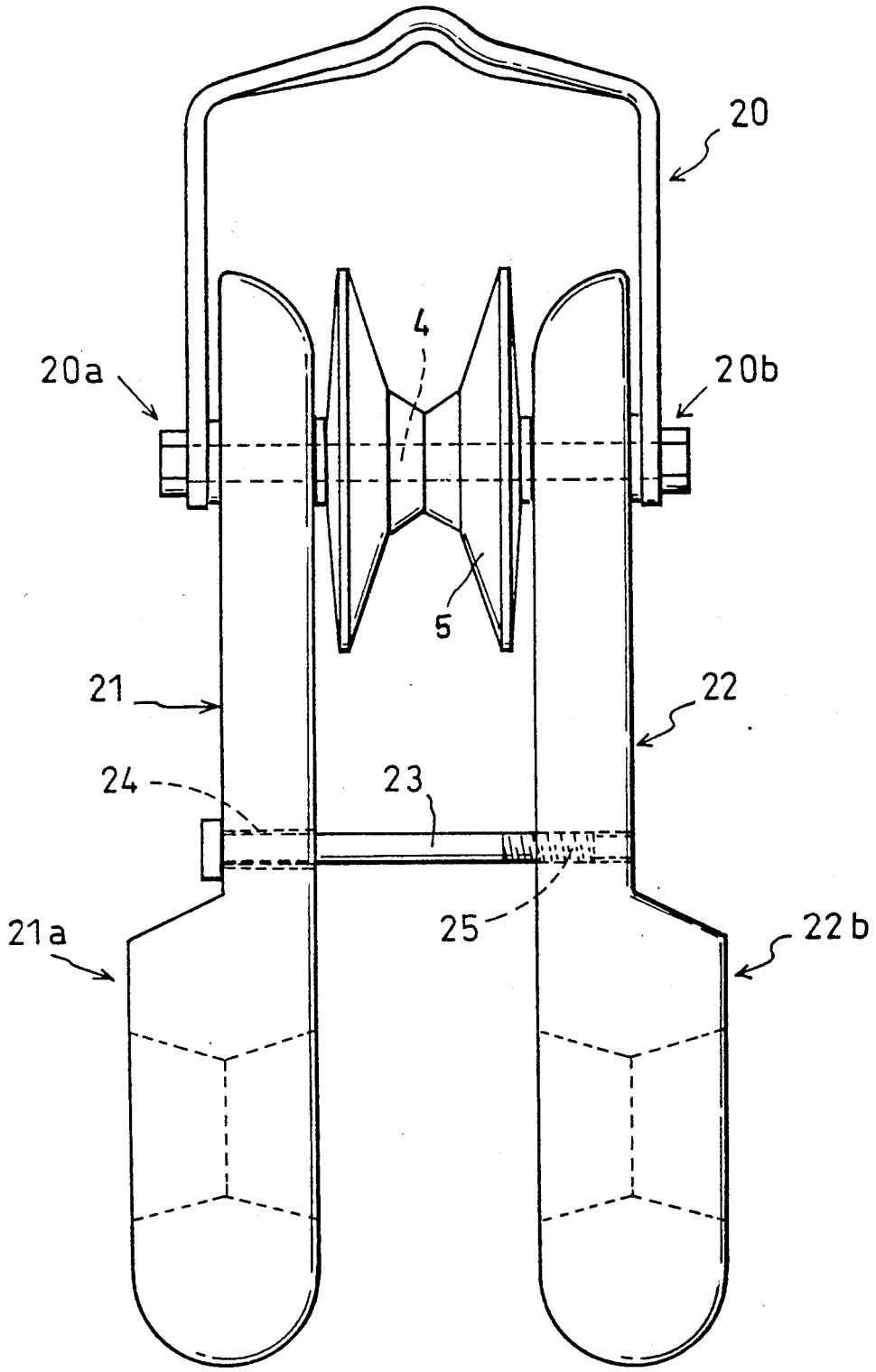
FIG. 5 is a side view of another embodiment of stabilizing piece.

Another embodiment is illustrated in FIG. 5, of which only the differences with respect to the first embodiment described hereinabove will be noted. The U-shaped support piece 20 has hollowed end parts 20*a* and 20*b*, which are placed on either side of the two masses 21 and 22. Masses 21 and 22 have an overall triangular shape, with the rotational pin passing through a zone corresponding to an apex of the triangle. Zones 21*a* and 22*a* opposite said apex present an outwardly facing swell. This particular arrangement makes it possible to increase the weight of the masses and to displace towards the lower part the centre of gravity of the device. A threaded rod 23 may optionally traverse the first mass 21, passing through a hole 24, and be fixed by screwing in a hole 25 with threaded wall located opposite the first hole 24 in the second mass 22. This safety rod 23 is placed after positioning of the device on the chain and avoids the devices moving away from the chain for any reason.

What is claimed is:

1. An anchoring device of the type having an anchor and a chain connecting the anchor to a craft, said anchoring device comprising:

a stabilizing piece having two identical masses and being fastened with the chain in an immersed stabilizing zone of the chain when the anchor is on sea-bed;

means for sliding the stabilizing piece along the chain within said zone under effect of tension shocks on the craft, said sliding means including a grooved pulley which rotates around a pin connecting the pulley with the two masses of the stabilizing piece in their peripheral zones respectively and U-shaped piece fixed with the pin on both sides of the pulley; and means for holding the stabilizing piece at a position within said immersed stabilizing zone of the chain, said holding means including a rope with one end fixed to the craft and another fixed to the support piece and with a length corresponding to a distance between the craft and the zone of the chain, wherein said zone is located at a distance from the point of attachment of the chain with the craft, but less than the depth of water beneath the craft.

2. The device of claim 1, wherein the masses have a triangular shape and the pin connects the two masses with the pulley at a given apex of the triangle of the masses.

3. The device of claim 1, wherein, for the craft having a tonnage of between 1.5 and 15 tons and a length of 6 to 15 metres, the stabilizing piece weighs from 15 to 30 kg.

4. The device of claim 1, wherein each mass comprises, in a peripheral zone opposite to the peripheral zone of the connection with the pulley, a slot for gripping.

5. The device of claim 1, wherein the pulley is made of bend rubber.

6. The device of claim 1, further comprising a removable safety rod connecting the two masses beneath the pin.

* * * * *